US011162244B2

(12) United States Patent
Tsukamoto

(10) Patent No.: US 11,162,244 B2
(45) Date of Patent: Nov. 2, 2021

(54) EXCAVATOR CONTROLLING POWER OF HYDRAULIC PUMP ACCORDING TO ORIENTATION OF FRONT WORK MACHINE

(71) Applicant: SUMITOMO(S.H.I.) CONSTRUCTION MACHINERY CO., LTD., Tokyo (JP)

(72) Inventor: Hiroyuki Tsukamoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/046,156

(22) Filed: Jul. 26, 2018

(65) Prior Publication Data

US 2018/0328003 A1 Nov. 15, 2018

Related U.S. Application Data

(63) Continuation of application No. PCT/JP2017/003035, filed on Jan. 27, 2017.

(30) Foreign Application Priority Data

Jan. 28, 2016 (JP) ..... JP2016-014727

(51) Int. Cl.
*E02F 9/22* (2006.01)
*F02D 29/04* (2006.01)
(Continued)

(52) U.S. Cl.
CPC ..... *E02F 9/2221* (2013.01); *E02F 3/32* (2013.01); *E02F 3/425* (2013.01); *E02F 9/20* (2013.01);
(Continued)

(58) Field of Classification Search
None
See application file for complete search history.

(56) References Cited

U.S. PATENT DOCUMENTS 5,682,311 A * 10/1997 Clark ..... E02F 3/435 172/4.5
5,933,346 A * 8/1999 Brabec ..... E02F 9/2025 340/684
(Continued)

FOREIGN PATENT DOCUMENTS

EP 2505725 10/2012
JP S62-052091 11/1987
(Continued)

OTHER PUBLICATIONS

International Search Report for PCT/JP2017/003035 dated Apr. 18, 2017.

*Primary Examiner* — Navid Ziaeianmehdizadeh
(74) *Attorney, Agent, or Firm* — IPUSA, PLLC

(57) ABSTRACT

An excavator includes a lower traveling body; an upper turning body mounted so as to turn with respect to the lower traveling body; a hydraulic pump connected to an engine; a front work machine including an end attachment, an arm, and a boom that are driven by hydraulic fluid from the hydraulic pump; a front work machine orientation detection part configured to detect an orientation of the front work machine; and a control unit configured to control a power of the hydraulic pump according to the orientation of the front work machine within a work area, based on a value detected by the front work machine orientation detection part.

13 Claims, 9 Drawing Sheets

(51) Int. Cl.

| | |
|---|---|
| ***F02D 29/00*** | (2006.01) |
| ***E02F 9/20*** | (2006.01) |
| ***E02F 3/32*** | (2006.01) |
| ***E02F 3/42*** | (2006.01) |
| ***E02F 9/26*** | (2006.01) |

(52) U.S. Cl.
CPC ..... *E02F 9/265* (2013.01); *F02D 29/00* (2013.01); *F02D 29/04* (2013.01)

(56) References Cited

U.S. PATENT DOCUMENTS

| | | | | |
|---|---|---|---|---|
| 9,593,466 | B2 * | 3/2017 | Magaki | E02F 9/2075 |
| 10,053,835 | B2 * | 8/2018 | Magaki | F02D 23/00 |
| 2005/0183571 | A1 * | 8/2005 | Cheong | E02F 9/2203 91/516 |
| 2012/0177470 | A1 | 7/2012 | Ohhigashi et al. | |
| 2012/0246981 | A1 * | 10/2012 | Magaki | E02F 9/2075 37/443 |
| 2012/0315119 | A1 * | 12/2012 | Magaki | B60W 20/00 414/685 |
| 2013/0345939 | A1 * | 12/2013 | Magaki | E02F 9/2214 701/50 |
| 2014/0088839 | A1 * | 3/2014 | Magaki | E02F 9/2214 701/50 |
| 2014/0313502 | A1 * | 10/2014 | Steele | E21C 35/00 356/4.01 |
| 2015/0249821 | A1 * | 9/2015 | Tanizumi | B60R 1/00 348/46 |
| 2016/0251833 | A1 * | 9/2016 | Kondo | E02F 9/2235 60/428 |
| 2017/0101761 | A1 | 4/2017 | Wu | |

FOREIGN PATENT DOCUMENTS

| | | |
|---|---|---|
| JP | H10-183689 | 7/1998 |
| JP | H10-252521 | 9/1998 |
| JP | 2004-324511 | 11/2004 |
| JP | 2013-002058 | 1/2013 |
| JP | 2015-068071 | 4/2015 |
| WO | 2012/121253 | 9/2012 |
| WO | 2015/194601 | 12/2015 |

* cited by examiner

EXCAVATOR CONTROLLING POWER OF HYDRAULIC PUMP ACCORDING TO ORIENTATION OF FRONT WORK MACHINE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2017/003035 filed on Jan. 27, 2017 and designating the U.S., which claims priority to Japanese Patent Application No. 2016-014727 filed on Jan. 28, 2016. The entire contents of the foregoing applications are incorporated herein by reference.

BACKGROUND OF THE INVENTION

1. Field of the Invention

The present invention relates to an excavator.

2. Description of the Related Art

Conventionally, a construction machine such as a hydraulic excavator has a work mode selection function for switching its output in order to adapt to different environments and usages. Examples of work modes that may be selected include high speed/power mode, fuel efficiency mode, and fine operation mode.

A configuration is known for determining a constant rotational speed for a selected work mode when an operator operating a throttle volume selects a work mode from a plurality of work modes according to the circumstance.

The workload of an excavator in performing work may vary depending on the orientation of a front work machine (attachment). As such, there may be a mismatch between the selected work mode and the workload.

For example, when the high speed/power mode is selected and the attachment is in an orientation that does not impose a heavy workload, excessive power may be output to thereby degrade operability and fuel efficiency.

SUMMARY OF THE INVENTION

One aspect of the present invention is directed to providing an excavator that can implement suitable output control according to the orientation of a front end machine to thereby improve operability and fuel efficiency.

According to one embodiment of the present invention, an excavator is provided that includes a lower traveling body; an upper turning body mounted so as to turn with respect to the lower traveling body; a hydraulic pump connected to an engine; a front work machine including an end attachment, an arm, and a boom that are driven by hydraulic fluid from the hydraulic pump; a front work machine orientation detection part configured to detect an orientation of the front work machine; and a control unit configured to control the power of the hydraulic pump according to the orientation of the front work machine within a work area, based on a value detected by the front work machine orientation detection part.

DESCRIPTION OF THE PREFERRED EMBODIMENTS

In the following, embodiments of the present invention will be described with reference to the accompanying drawings.

Figure 1:
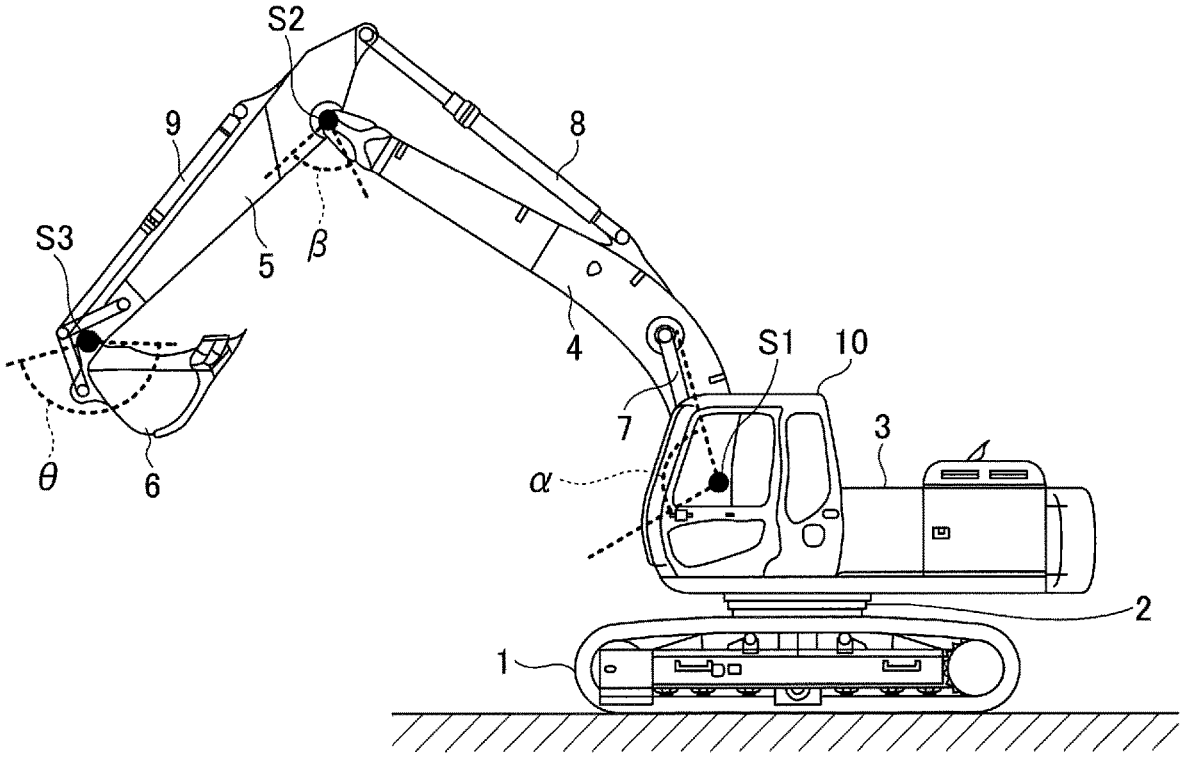
FIG. 1 is a side view of an excavator.

FIG. 1 is a side view of a hydraulic excavator according to an embodiment of the present invention.

The hydraulic excavator includes a crawler type lower traveling body 1 and an upper turning body 3 that is mounted on the lower traveling body 1 via a turning mechanism 2 so as to turn with respect to the lower traveling body 1.

A boom 4 is attached to the upper turning body 3. An arm 5 is attached to the distal end of the boom 4, and a bucket 6 as an end attachment is attached to the distal end of the arm 5. The boom 4, the arm 5, and the bucket 6 constitute an attachment corresponding to a front work machine. The boom 4, the arm 5, and the bucket 6 are hydraulically driven by corresponding hydraulic actuators, i.e., a boom cylinder 7, an arm cylinder 8, and a bucket cylinder 9. The upper turning body 3 includes a cabin 10 and has a power source such as an engine installed therein. Note that although the bucket 6 is illustrated as an example end attachment in FIG. 1, the bucket 6 may be replaced by a lifting magnet, a breaker, a fork, or the like, for example.

The boom 4 is rotatably supported to be movable upward/downward with respect to the upper turning body 3. A boom angle sensor S1 as a front work machine orientation detection part is attached to a turning support portion (joint) corresponding to a connecting point of the boom 4 and the upper turning body 3. The boom angle sensor S1 can detect a boom angle $\alpha$ corresponding to the tilt angle of the boom 4 (upward tilt angle from lowest position of the boom 4). The boom angle $\alpha$ reaches its maximum value when the boom 4 is fully raised to its highest position.

The arm 5 is rotatably supported with respect to the boom 4. An arm angle sensor S2 as a front work machine orientation detection part is attached to a turning support portion (joint) corresponding to a connecting point of the arm 5 and the boom 4. The arm angle sensor S2 can detect an arm angle β corresponding to the tilt angle of the arm 4 (opening angle from most closed position of the arm 5). The arm angle β reaches its maximum value when the arm 5 is fully opened to its most open position.

The bucket 6 is rotatably supported with respect to the arm 5. A bucket angle sensor S3 as a front work machine orientation detection part is attached to a turning support portion (joint) corresponding to a connecting point of the bucket 6 and the arm 5. The bucket angle sensor S3 can detect a bucket angle θ corresponding to the tilt angle of the bucket 6 (opening angle from most closed position of the bucket 6). The bucket angle θ reaches its maximum value when the bucket 6 is fully opened to its most open position.

The boom angle sensor S1, the arm angle sensor S2, and the bucket angle sensor S3 may be a potentiometer using a variable resistor, a stroke sensor detecting a stroke amount of a corresponding hydraulic cylinder, a rotary encoder detecting a turning angle around a connecting pin, an acceleration sensor, a gyro sensor, or the like. The above sensors may also be a combination of an acceleration sensor and a gyro sensor, or a device that detects the operation amount of an operation lever, for example. In this way, an "orientation of the front work machine" including the orientation (angle) of the boom 4 and the orientation (angle) of the arm 5 is determined based on values detected by the front work machine orientation detection part. Note that the "orientation of the front work machine" may also include the position and orientation (angle) of the bucket 6, for example. The front work machine orientation detection part may be a camera, for example. The camera may be attached to a front portion of the upper turning body 3 so that the camera can photograph an image of the front work machine (attachment), for example. The camera used as the front work machine orientation detection part may also be a camera attached to an aircraft flying around the excavator or a camera attached to a building installed at the work site, for example. The camera used as the front work machine orientation detection part may detect the orientation of the front work machine by detecting a change in the position of the bucket 6 in the photographed image or a change in the position of the arm 5 in the photographed image, for example.

Figure 2:
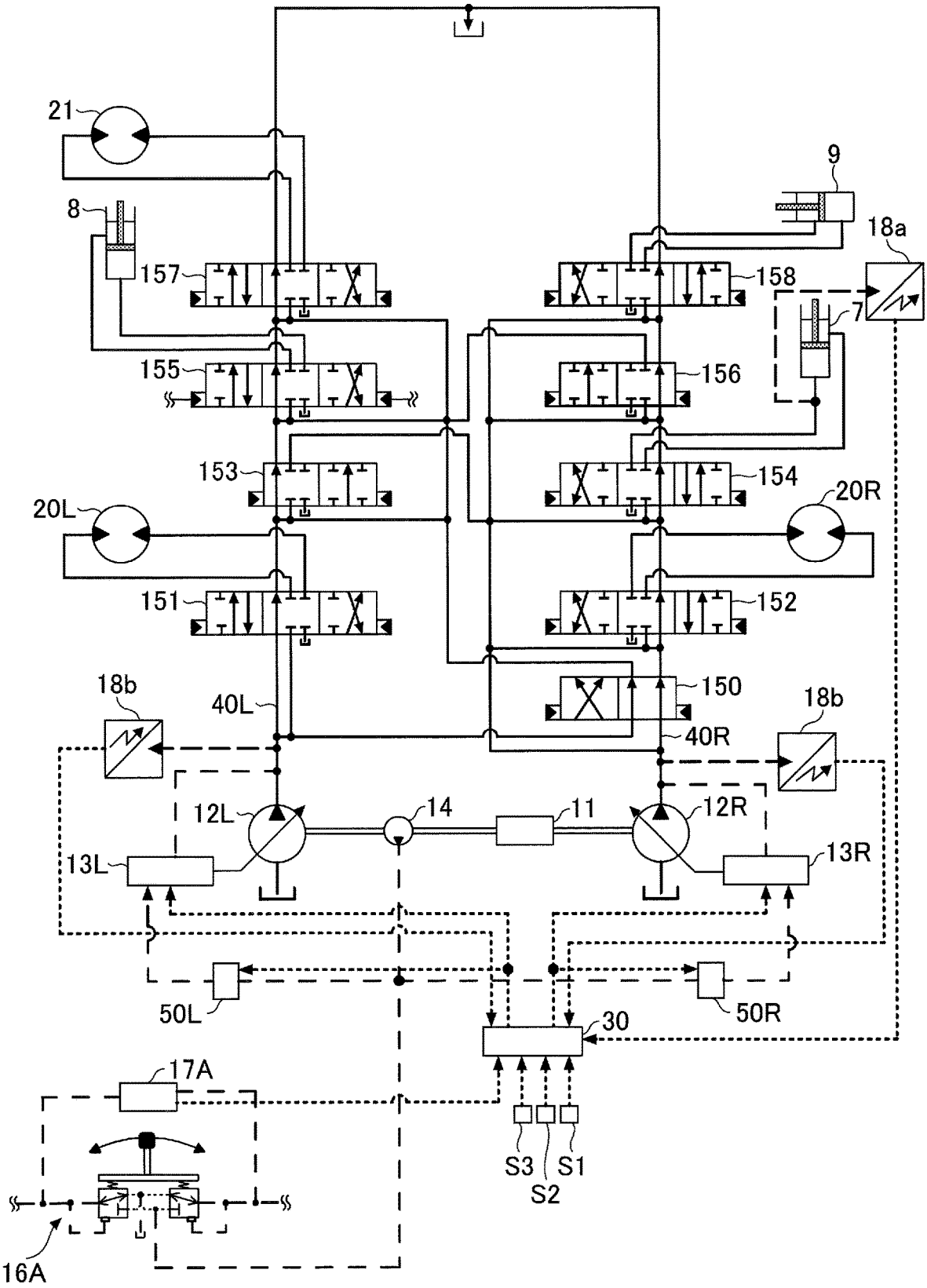
FIG. 2 is a schematic diagram illustrating an example configuration of a hydraulic system installed in the excavator.

FIG. 2 is a schematic diagram illustrating an example configuration of a hydraulic system installed in the hydraulic excavator according to the present embodiment. In FIG. 2, a mechanical power system, a high pressure hydraulic line, a pilot line, and an electric drive/control system are respectively represented by a double line, a solid line, a broken line, and a dotted line.

In the present embodiment, the hydraulic system has hydraulic fluid circulating from main pumps 12L and 12R, corresponding to hydraulic pumps driven by an engine 11, to a hydraulic fluid tank via center bypass pipelines 40L and 40R, respectively.

The center bypass pipeline 40L is a high pressure hydraulic line that communicates with flow control valves 151, 153, 155, and 157 that are arranged in a control valve. The center bypass pipeline 40R is a high pressure hydraulic line that communicates with flow control valves 150, 152, 154, 156, and 158 that are arranged in the control valve.

The flow control valves 153 and 154 are spool valves for switching the flow of hydraulic fluid between supplying hydraulic fluid discharged from the main pumps 12L and 12R to a boom cylinder 7 and discharging the hydraulic fluid in the boom cylinder 7 to the hydraulic fluid tank.

The flow control valves 155 and 156 are spool valves for switching the flow of hydraulic fluid between supplying hydraulic fluid discharged from the main pumps 12L and 12R to an arm cylinder 8 and discharging the hydraulic fluid in the arm cylinder 8 to the hydraulic fluid tank.

The flow control valve 157 is a spool valve for switching the flow of hydraulic fluid in order to circulate hydraulic fluid discharged from the main pump 12L in a turning hydraulic motor 21.

The flow control valve 158 is a spool valve for switching the flow of hydraulic fluid from supplying hydraulic fluid discharged from the main pump 12R to a bucket cylinder 9 and discharging the hydraulic fluid in the bucket cylinder 9 to the hydraulic fluid tank.

Regulators 13L and 13R control the discharge amounts of the main pumps 12L and 12R by adjusting swash plate tilt angles of the main pumps 12L and 12R according to the discharge pressures of the main pumps 12L and 12R (by total power control). More specifically, pressure reducing valves 50L and 50R are provided in a pipeline interconnecting the pilot pump 14 and the regulators 13L and 13R. The pressure reducing valves 50L, 50R adjust the swash plate tilt angles of the main pumps 12L and 12R by shifting control pressures acting on the regulators 13L and 13R. When the discharge pressures of the main pumps 12L and 12R become greater than or equal to a predetermined value, the pressure reducing valves 50L and 50R decrease the discharge amounts of the main pumps 12L and 12R so that the pump power (horsepower) represented by the product of the discharge pressure and the discharge amount does not exceed the power of the engine 11. The pressure reducing valves 50L and 50R may be electromagnetic proportional valves, for example.

An arm operation lever 16A is an operation device for controlling opening/closing of the arm 5. The arm operation lever 16A uses hydraulic fluid discharged from the pilot pump 14 to introduce a control pressure corresponding to a lever operation amount into either a right or left pilot port of the flow control valve 155. Depending on the operation amount, the arm operation lever 16A may introduce a control pressure into a left pilot port of the flow control valve 156.

A pressure sensor 17A detects the operation content of an operation of the arm operation lever 16A by an operator in the form of pressure and outputs the detected value of the pressure to a controller 30 corresponding to a control unit. The operation content may include the lever operation direction and the lever operation amount (lever operation angle), for example.

Also, operation devices including a left/right traveling lever (or pedal), a boom operation lever, a bucket operation lever, and a turning operation lever (not shown) respectively for running the lower traveling body 1, raising/lowering the boom 4, opening/closing the bucket 6, and turning the upper turning body 3 are provided. Like the arm operation lever 16A, each of these operation devices use hydraulic fluid discharged from the pilot pump 14 to introduce a control pressure corresponding to its lever operation amount (or pedal operation amount) to a left or right pilot port of the flow control valve for the corresponding hydraulic actuator. Also, the operation content of operations of these operation devices by the operator are detected in the form of pressure by corresponding pressure sensors similar to the pressure sensor 17A, and the detected pressure values are output to the controller 30.

The controller 30 receives outputs of the boom angle sensor S1, the arm angle sensor S2, the bucket angle sensor S3, the pressure sensor 17A, a boom cylinder pressure sensor 18*a*, a discharge pressure sensor 18*b*, a pressure sensor (not shown) for detecting a negative control pressure, and the like, and outputs control signals to the engine 11, the regulators 13R and 13L, and the like as appropriate.

In this way, the controller 30 outputs control signals to the regulators 13L and 13R according to the orientation of the boom 4 or the orientation of the arm 5, for example. The regulators 13L and 13R change the discharge flow rates of the main pumps 12L and 12R in response to control signals from the controller 30 to control the pump power of the main pumps 12L and 12R.

Figure 3:
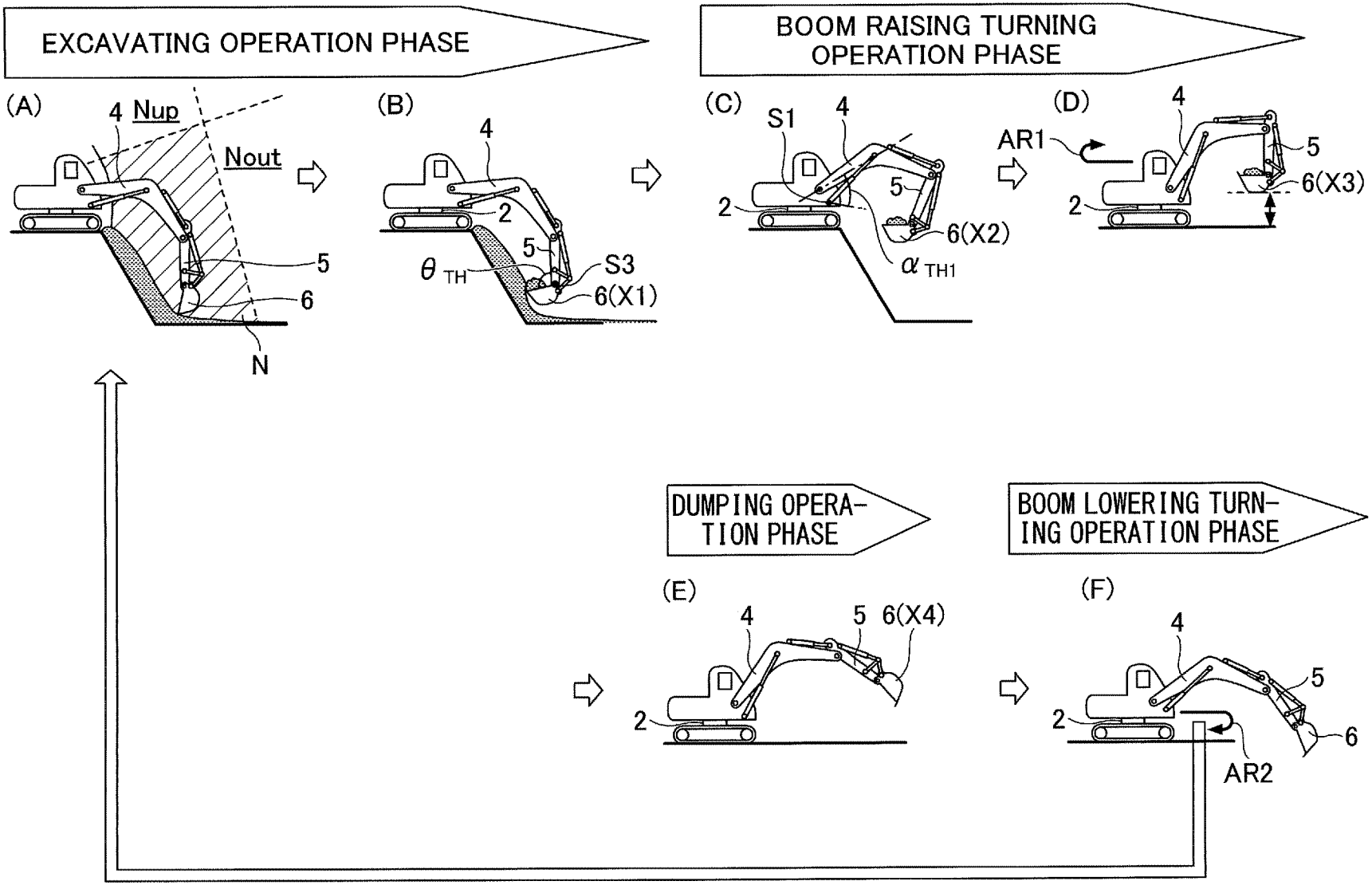
FIG. 3 is a diagram illustrating an operation flow of a deep digging excavating/loading operation performed by the excavator.

In the following, a deep digging excavating/loading operation will be described with reference to FIG. 3. The hatched area illustrated in (A) of FIG. 3 represents a work area N of the attachment. The work area N represents a residing area of the end attachment excluding an upper area Nup and a distal end area Nout.

The upper area Nup may be defined as a residing area of the end attachment when the boom angle $\alpha$ is within 10 degrees from its maximum angle, for example.

The distal end area Nout may be defined as a residing area of the end attachment when the boom angle $\alpha$ is greater than or equal to a threshold value and the arm angle $\beta$ is within 10 degrees from its maximum angle, for example. In this way, the controller 30 can determine whether the bucket 6 is residing within the work area N based on the boom angle $\alpha$ and the arm angle $\beta$.

As illustrated in (A) of FIG. 3, the operator first performs a boom lowering operation within the work area N. When the boom angle $\alpha$ becomes less than or equal to a predetermined threshold value $\alpha_{TH3}$, the excavator determines that a deep digging excavating operation is being performed. The operator adjusts the position of the bucket 6 so that the distal end of the bucket 6 is at a desired height position with respect to an excavation target, and then, as illustrated in (B) of FIG. 3, the operator gradually closes the bucket 6 from an open state. At this time, excavated soil enters the bucket 6. The operation of the excavator at this time is referred to as excavating operation, and such operation phase is referred to as excavating operation phase. A relatively large amount of pump power is required in the excavating operation phase. The bucket position of the bucket 6 illustrated in (B) of FIG. 3 is denoted as (X1), and the bucket angle A of the bucket 6 at this time is denoted as "$\theta_{TH}$".

Then, the operator raises the boom 4 to raise the bucket 6 to the position as illustrated in (C) of FIG. 3 while maintaining the upper edge of the bucket 6 substantially horizontal. The bucket position of the bucket 6 illustrated in (C) of FIG. 3 is denoted as (X2), and the boom angle $\alpha$ of the boom 4 at this time is set up as a first threshold value $\alpha_{TH1}$.

Then, the operator raises the boom 4 until the bottom of the bucket 6 reaches a desired height from the ground as illustrated in (D) of FIG. 3. The desired height is may be a height greater than or equal to the height of a dump, for example. Subsequently or at the same time, the operator turns the upper turning body 3 in the direction indicated by arrow AR1 to move the bucket 6 to a position where it can deposit the excavated soil. The operation of the excavator at this time is referred to as a boom raising turning operation, and such operation phase is referred to as a boom raising turning operation phase. A relatively large amount of pump power is required in the initial stage of the boom 4 raising operation, and the required pump power gradually decreases as the boom 4 rises higher (in combination with a turning operation). The bucket position of the bucket 6 illustrated in (D) of FIG. 3 is denoted as (X3).

After the operator completes the boom raising turning operation, the operator opens the arm 5 and the bucket 6 as illustrated in (E) of FIG. 3 to deposit the soil accommodated in the bucket 6. The operation of the excavator at this time is referred to as a dumping operation, and such operation phase is referred to as a dumping operation phase. In the dumping operation, the operator may only open the bucket 6 to deposit the excavated soil. A relatively small amount of pump power is required in the dumping operation phase. The bucket position of the bucket 6 illustrated in (E) of FIG. 3 is denoted as (X4).

After the operator completes the dumping operation, the operator turns the upper turning body 3 in the direction indicated by arrow AR2 as illustrated in (F) of FIG. 3 to move the bucket 6 to a position just above the excavation position. At this time, in conjunction with a turning operation, the boom 4 is lowered to lower the bucket 6 to a desired height from the excavation target. The operation of the excavator at this time is referred to as a boom lowering turning operation, and such operation phase is referred to as a boom lowering turning operation phase. The pump power required in the boom lowering turning operation phase is lower than the pump power required in the dumping operation phase.

The operator repeats the above cycle including the "excavating operation", the "boom raising turning operation", the "dumping operation", and the "boom lowering turning operation" to advance the deep digging excavating/loading operation in the work area N.

In the following, an overview of control according to the present embodiment is briefly described with reference to FIGS. 4A and 4B.

Figure 4A:
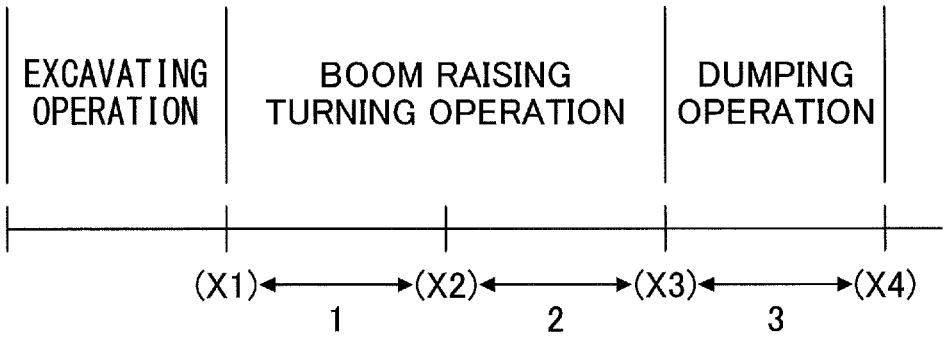
FIG. 4A is a diagram illustrating the concept of excavator control according to one embodiment of the present invention.

FIG. 4A illustrates the relationship between spatial areas including the bucket positions (X1) to (X4) in FIG. 3 and the operation of the excavator. As illustrated in FIG. 4A, the bucket 6 is included in spatial area "1" when the bucket 6 moves from bucket position (X1) to bucket position (X2), the bucket 6 is included in spatial area "2" when the bucket 6 moves from bucket position (X2) to bucket position (X3), and the bucket 6 is included in spatial area "3" when the bucket 6 moves from bucket position (X3) to bucket position (X4). The excavator requires high pump power when the bucket position is in spatial area "1", requires control to have the pump power gradually lowered while the bucket position is in spatial area "2", and requires even lower pump power when the bucket position is in spatial area "3". In FIG. 4A, the bucket 6 resides in spatial area "1" during the first half of the boom raising turning operation, the bucket 6 resides in spatial area "2" during the latter half of the boom raising turning operation, and the bucket 6 resides in spatial area "3" during the dumping operation.

Figure 4B:
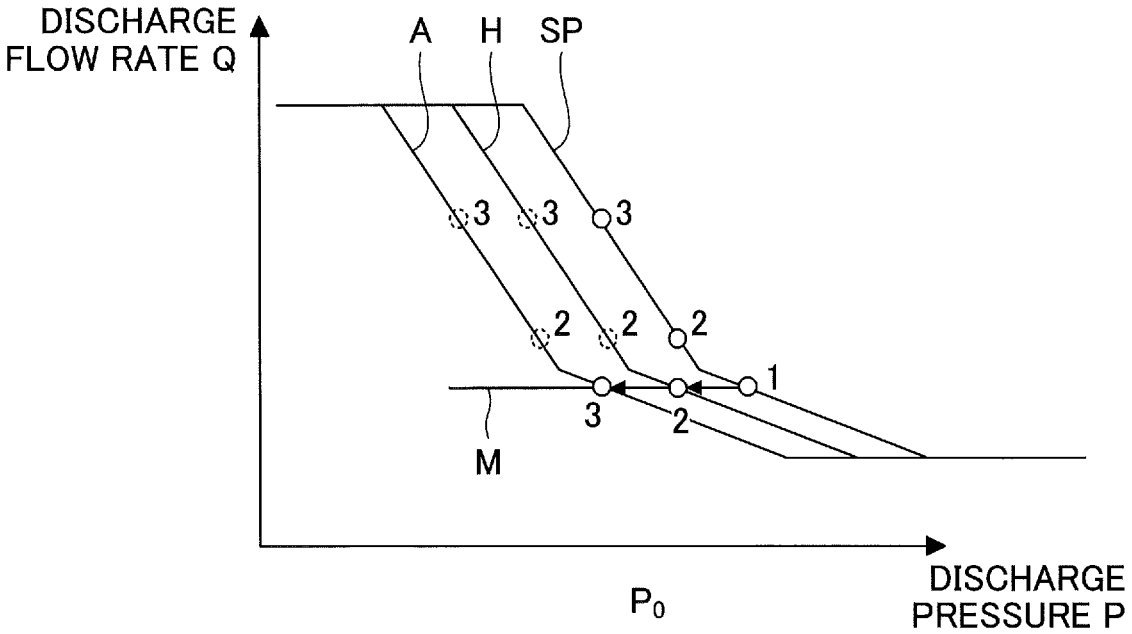
FIG. 4B is another diagram illustrating the concept of excavator control according to the one embodiment.

FIG. 4B illustrates an overview of control implemented in spatial area "1" to spatial area "3". In FIG. 4B, the vertical axis represents the discharge flow rate Q of the main pumps 12L and 12R, and the horizontal axis represents the discharge pressure P of the main pumps 12L and 12R. Graph line SP represents the relationship between the discharge flow rate Q and the discharge pressure P in SP mode corresponding to a high speed/power mode. Graph line H represents the relationship between the discharge flow rate Q and the discharge pressure P in H mode corresponding to a fuel efficiency mode. Graph line A represents the relationship between the discharge flow rate Q and the discharge pressure P in A mode corresponding to a fine operation mode. Graph line M represents the relationship between the discharge flow rate Q and the discharge pressure P in the present embodiment.

Conventionally, when the work mode is determined, the swash plate tilt angles of the main pumps 12L and 12R are controlled by the regulators 13R and 13L so that the relationship between the discharge flow rate Q and the discharge pressure P conform to the graph lines as illustrated in FIG. 4B, for example.

For example, with respect to graph line SP, when the bucket 6 moves from spatial area "1" to spatial area "2" and then to spatial area "3", the discharge flow rate Q increases as the discharge pressure P (workload) gradually decreases through power constant control, and as such, the operation speed of the attachment increases.

In particular, in the boom raising turning operation and the dumping operation, the operator has to perform these operations while finely adjusting the position of the bucket 6. As such, operability may be substantially compromised when the pump power is so high. Further, because only a relatively low pump power is required in the boom raising turning operation and the dumping operation, unnecessary hydraulic fluid may be discharged and fuel efficiency may be compromised if the SP mode is maintained.

The control according to the present embodiment is represented by graph line M and involves pump power shift control by tracking the orientation of the attachment. That is, the pump power is controlled to be high when the bucket 6 is in spatial area "1", and the pump power is controlled to gradually decrease when the bucket 6 is in spatial area "2", and the pump power is controlled to be even lower when the bucket 6 is in spatial area "3".

Specifically, as the bucket 6 moves from spatial area "1" to spatial area "2" and from spatial area "2" to spatial area "3" in response to changes in the orientation (angle) of the boom 4 corresponding to the "orientation of the front work machine", the pump power is controlled to decrease so that that the discharge flow rate Q remains constant. At this time, the rotational speed of the engine 11 is controlled to be constant and remain unchanged.

When the discharge flow rate Q is constant, the operation speed of the attachment becomes constant. As a result, operability during the boom raising turning operation and the dumping operation may be substantially improved. Also, the discharge flow rate Q in the boom raising turning operation and the dumping operation may be substantially reduced as compared with conventional control (see illustrated graph lines) to thereby improve fuel efficiency.

Figure 5:
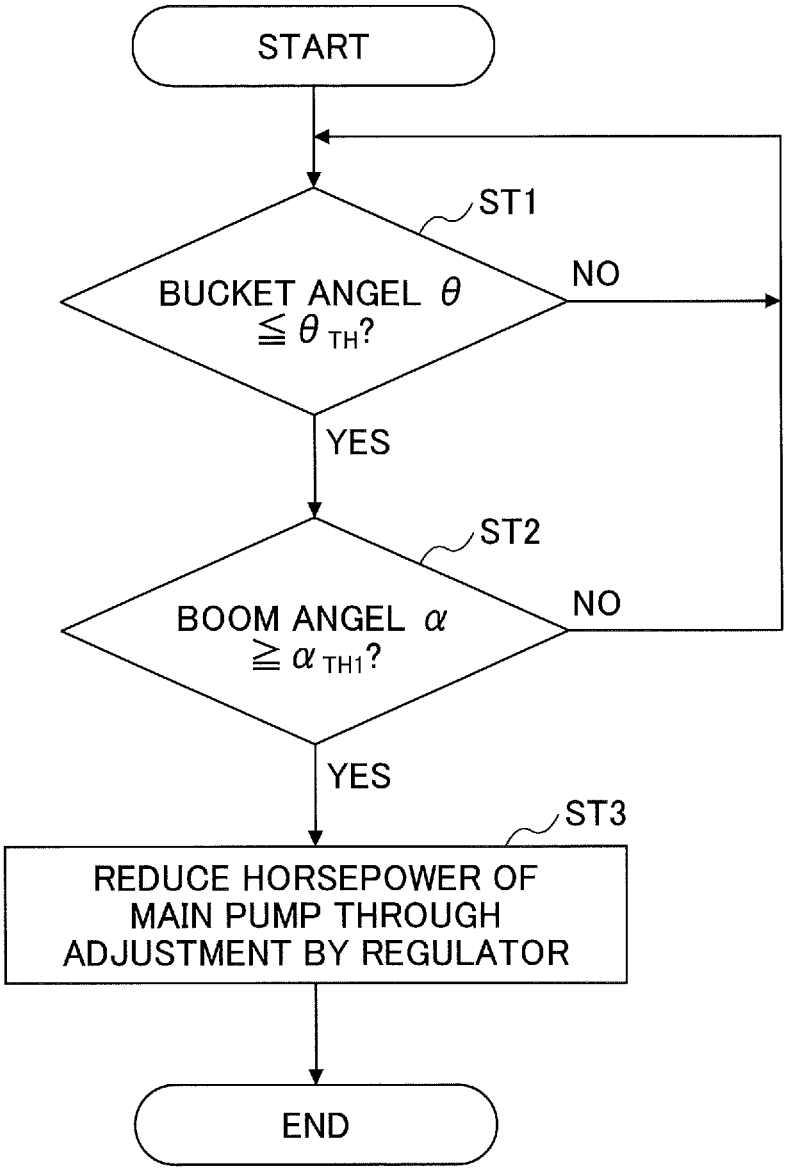
FIG. 5 is a flowchart illustrating a process flow of excavator control according to the one embodiment.

In the following, a process of controlling power according to the angle of the boom 4 will be described with reference to FIG. 5. FIG. 5 is a flowchart illustrating the start timings for reducing the pump power of the main pumps 12R and 12L. The flowchart of FIG. 5 illustrates an example case of performing a deep digging excavating/loading operation in which the work mode is initially set to the SP mode corresponding to the high speed/power mode (see graph line SP in FIG. 4A).

Based on the value of the bucket angle θ detected by the bucket angle sensor S3, the controller 30 determines whether the bucket angle θ is less than or equal to a predetermined value $\theta_{TH}$ (step ST1). In this way, the controller 30 can determine whether the excavating operation has ended.

The predetermined value $\theta_{TH}$ may be set to 70 degrees, for example. The predetermined value $\theta_{TH}$ may be suitably changed according to the work content. Note that as the bucket 6 closes, the bucket angle θ decreases. If the bucket angle θ is greater than the predetermined value $\theta_{TH}$ (NO in step ST1), the controller 30 repeats the process of ST1 until the bucket angle θ becomes less than or equal to the predetermined value $\theta_{TH}$.

If the bucket angle θ is less than or equal to the predetermined value $\theta_{TH}$ (YES in step ST1), the controller 30 determines whether the boom angle α is greater than or equal to the predetermined first threshold value $\alpha_{TH1}$ based on the boom angle α detected by the boom angle sensor S1 (step ST2). If the boom angle α is less than the first threshold value $\alpha_{TH1}$ (NO in step ST2), the controller 30 returns to step ST1.

The first threshold value $\alpha_{TH1}$ may be set to 30 degrees, for example. The first threshold value $\alpha_{TH1}$ may be suitably changed according to the work content.

If the boom angle α is greater than or equal to the first threshold value $\alpha_{TH1}$ (YES in step ST2), the controller 30 determines that the operation phase has changed from the excavating operation phase to the boom raising turning operation phase and controls the pump power of the main pumps 12L and 12R to decrease such that the operation speed of the hydraulic actuators gradually decreases (step ST3). Specifically, the controller 30 applies the control pressure shift controlled by the pressure reducing valves 50L and 50R to the regulators 13L and 13R. The regulators 13L and 13R gradually reduce the pump power of the main pumps 12L and 12R by adjusting their swash plate tilt angles. At this time, the controller 30 reduces the pump power of the main pumps 12R and 12L in a manner such that the discharge flow rate Q of the main pumps 12R and 12L remains constant.

As described above, when the controller 30 determines that the bucket angle θ is less than or equal to the predetermined value $\theta_{TH}$ and the boom angle α is greater than or equal to the first threshold value $\alpha_{TH1}$, the controller 30 gradually reduces the pump power of the main pumps 12L and 12R. That is, the flow rate of hydraulic fluid circulating through the boom cylinder 7 and the overall hydraulic circuit is reduced. In this way, unnecessary energy consumption (e.g., fuel consumption) as a result of operating the arm 5 or the bucket 6 at high speed even when such high speed operation of the arm 5 or the bucket 6 is unnecessary may be avoided and fuel efficiency can be improved. Note that the process represented by the flowchart of FIG. 5 may be repeated at a predetermined control cycle.

Figure 6:
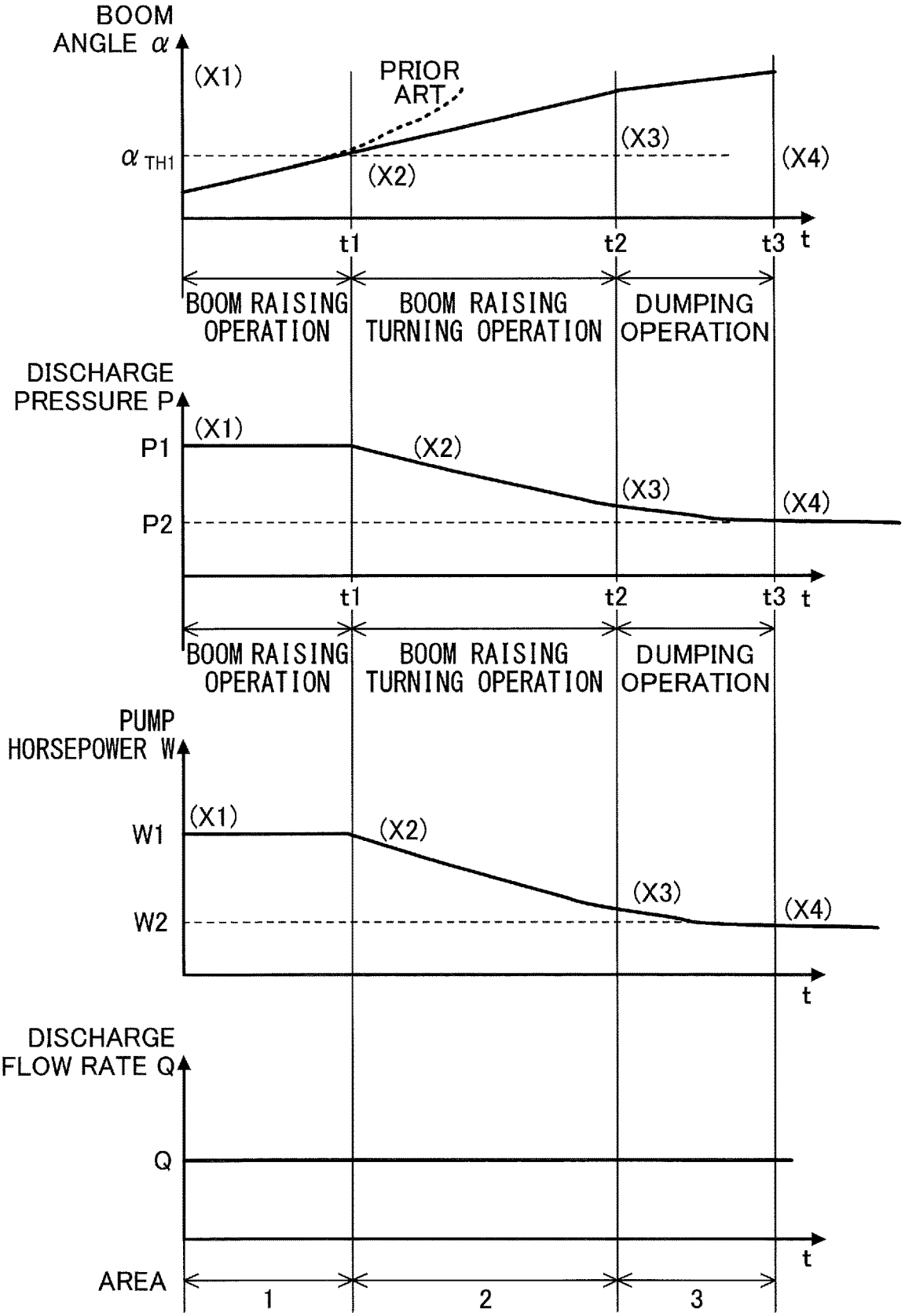
FIG. 6 is a diagram illustrating temporal transitions of the boom orientation (angle), discharge pressure, pump power, and discharge flow rate in the operation flow of FIG. 3.

In the following, temporal transitions of the boom angle α, the discharge pressure P, the pump power W, the discharge flow rate Q, and the spatial area including the bucket position in response to pump power reduction control by the controller 30 are described with reference to FIG. 6. Note that the lever operation amounts of the boom operation lever (not shown) and the arm operation lever 16A are constant. Also, the pump power is reduced by adjusting the regulators 13L and 13R. In FIG. 6, the discharge flow rate Q represents the discharge flow rates of both the main pumps 12L and 12R. That is, the discharge flow rates of the main pumps 12L and 12R follow the same transition.

As illustrated in FIG. 6, when the boom angle α becomes greater than or equal to the first threshold value $\alpha_{TH1}$ at time t1, the controller 30 determines that the excavating operation has ended and the bucket position has entered spatial area "2".

Then, the controller 30 adjusts the swash plate tilt angle via the regulators 13L and 13R, and gradually reduces the pump power in a manner such that the discharge flow rate Q of the main pumps 12L and 12R remains constant (discharge flow rate Q is not raised). As a result of reducing the pump power W of the main pumps 12L and 12R in the above-described manner, the speed at which the boom angle α increases (opens) may be lower as compared with the case where the pump power is not reduced.

As the time progresses from time t2 to time t3; namely, as the bucket 6 moves from spatial area "2" to spatial area "3", the discharge pressure P of the pump gradually decreases from P1 to P2. Likewise, the pump power W gradually decreases from W1 to W2.

As described above, the excavator according to the present embodiment is configured to control the pump power W to gradually decrease while maintaining the discharge flow rate Q constant. In this way, when raising the boom 4, the operation speed of the attachment may be prevented from accelerating as soon as the boom angle α becomes greater than or equal to the first threshold value $\alpha_{TH1}$ and the operator may be prevented from experiencing a sense of awkwardness.

The period from time 0 to t1 corresponds to the boom raising operation phase, the period from time t1 to time t2 corresponds to the boom raising turning operation phase (combined operation phase), the period from time t2 to time t3 corresponds to the dumping operation phase.

As can be appreciated, in the present embodiment, the pump power of the hydraulic pump is controlled according to the orientation of the front work machine within the work area N. As a result, in the excavator according to the present embodiment, even when the load (discharge pressure P) decreases, the discharge flow rate Q remains constant and the operation speed of the attachment (boom 4) does not accelerate. In this way, operability and fuel efficiency may be substantially improved in the excavator according to the present embodiment as compared with that implementing the conventional control in which the pump power is maintained constant (e.g., control in SP mode).

Note that after the controller 30 implements the control for preventing the operation speed of the attachment from accelerating, if the excavating operation as illustrated in (A) of FIG. 3 is to be performed once again or if it is determined that the boom angle α is less than the first threshold value $\alpha_{TH1}$, the controller 30 may control the operation speed of the attachment to return to its original speed, for example. Note that the controller 30 may also detect a change in the operation phase using the operation amount of the boom 4 as a detection of the orientation of the front work machine. In this case, a change from the excavating operation phase to the boom raising turning operation phase may be determined based on the duration of a period in which the boom operation amount is maximized.

Figure 7:
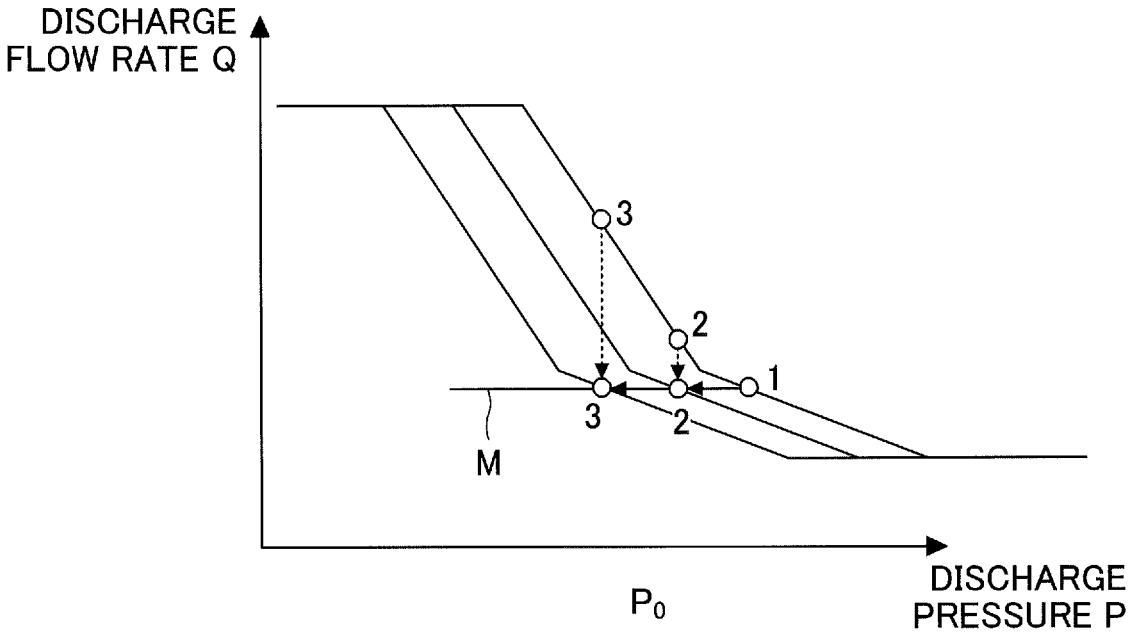
FIG. 7 is a diagram illustrating the concept of excavator control according to an alternative embodiment of the present invention.

In the following, an excavator according to an alternative embodiment will be described. The alternative embodiment is based on the same technical concept as the above-described embodiment, and as such, features of the alternative embodiment that differ from the above-described embodiment will be described below. FIG. 7 illustrates control implemented by the excavator according to the alternative embodiment.

The control illustrated in FIG. 7 has basic features that are substantially identical to those of the control illustrated in FIGS. 4A and 4B, and as such, overlapping descriptions will be omitted. The control according to the alternative embodiment similarly involves pump power shift control by tracking the orientation of the attachment.

In the control illustrated in FIG. 4B, as the bucket position moves from spatial area "1" to spatial area "2" and from spatial area "2" to spatial area "3" in response to changes in the orientation of the attachment, the pump power is gradually reduced so that the discharge flow rate Q remains constant (does not change). At this time, the rotational speed of the engine 11 is not changed.

On the other hand, in the control illustrated in FIG. 7, as the bucket position moves from spatial area "1" to spatial area "2" and from spatial area "2" to spatial area "3" in response to changes in the orientation of the attachment, the rotational speed of the engine 11 is gradually reduced so that the discharge flow rate Q remains constant.

As described above, the excavator according to the alternative embodiment reduces the rotational speed of the engine 11 in order to prevent the operation speed of the attachment (the arm 5 or the bucket 6) from accelerating. Such a feature differs from the excavator according to the above-described embodiment that uses the regulators 13L and 13R to adjust the pump power. However, other features of the alternative embodiment may be substantially identical to those of the above-described embodiment.

Thus, the discharge flow rate Q is maintained constant and the operation speed of the attachment (the boom 4) is maintained constant in the alternative embodiment as well, and in this way, operability and fuel efficiency may be substantially improved.

In the following, an excavator according to yet another alternative embodiment of the present invention will be described with reference to FIGS. 8 and 9.

The present alternative embodiment relates to control implemented in a "normal excavating/loading operation" such as a shallow digging excavating/loading operation as opposed to the "deep digging excavating/loading operation" as illustrated in FIG. 3.

Note that the present alternative embodiment also implements a configuration and a basic control concept substantially similar to those of the two previously described embodiments, and as such, overlapping descriptions will be omitted. In the following, the "normal excavating/loading operation" according to the present alternative embodiment will be described in detail.

Figure 8:
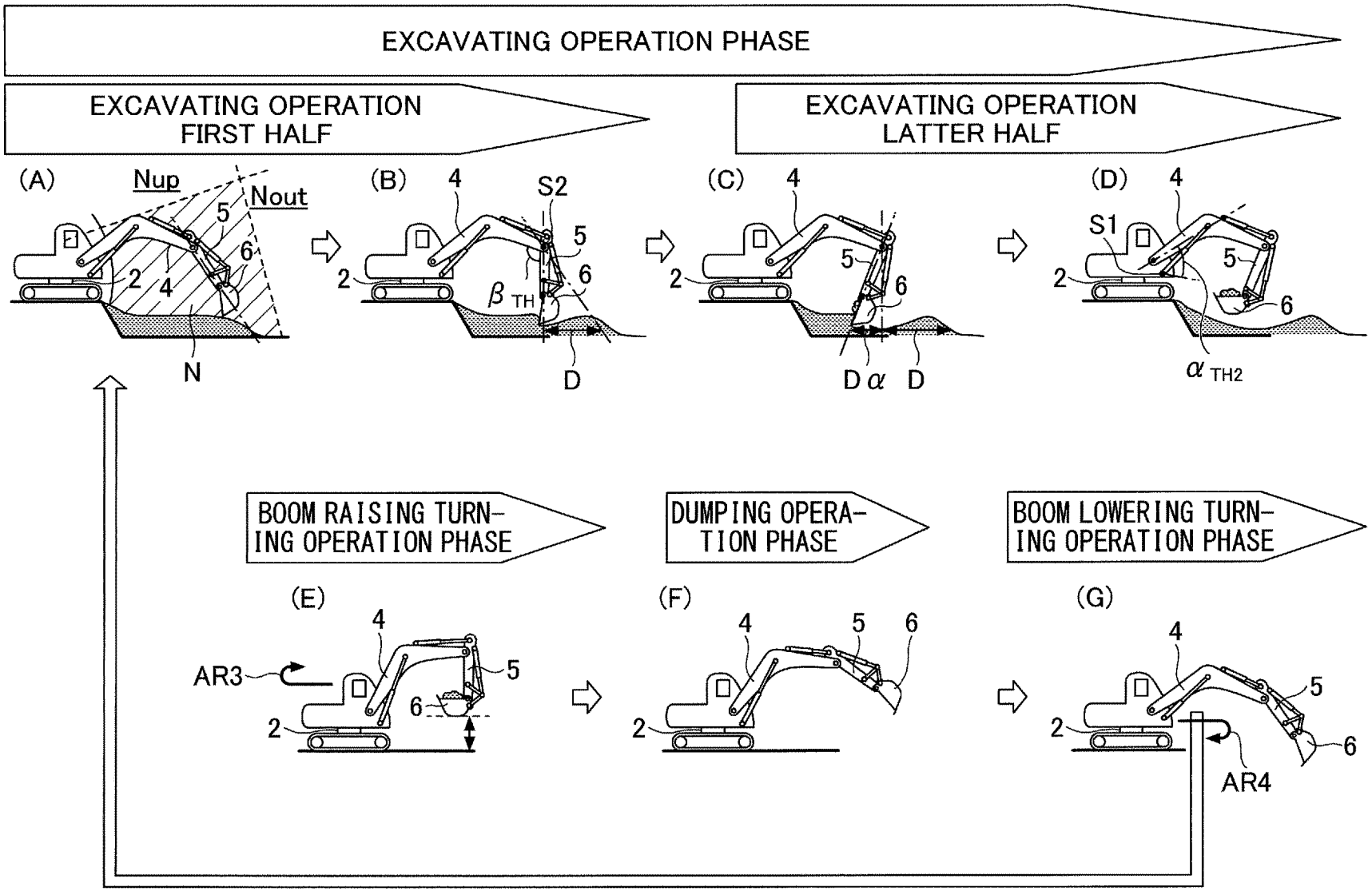
FIG. 8 is diagram illustrating an operation flow of a normal excavating/loading operation performed by the excavator according to another alternative embodiment of the present invention.

In FIG. 8, (A) to (D) illustrate various stages of an excavating operation being performed by the excavator. The excavating operation according to the present alternative embodiment is divided into an excavating operation first half as illustrated in (A) and (B) of FIG. 8, and an excavating operation latter half as illustrated in (C) and (D).

The hatched area illustrated in (A) of FIG. 8 represents the work area N of the attachment. The work area N represents a residing area of the end attachment excluding the upper area Nup and the distal end area Nout.

The upper area Nup may be defined as the residing area of the end attachment when the boom angle α is within 10 degrees from its maximum angle, for example.

The distal end area Nout may be defined as the residing area of the end attachment when the boom angle α is greater than or equal to a threshold value and the arm angle β is within 10 degrees from its maximum angle, for example. Thus, the controller 30 can determine whether the bucket 6 is residing within the work area N based on the boom angle α and the arm angle β.

As illustrated in (A) of FIG. 8, when the boom angle α is greater than a predetermined threshold value $\alpha_{TH3}$, the excavator determines that a normal excavating operation is being performed. The operator adjusts the position of the bucket 6 so that the distal end of the bucket 6 is at a desired height position with respect to an excavation target, and then, the operator closes the arm 5 from an open state until the arm 5 becomes substantially perpendicular (about 90 degrees) to the ground as illustrated in (B) of FIG. 8. By this operation, soil at a certain depth is excavated and the excavation target in area D is gathered until the arm 5 becomes substantially perpendicular to the ground surface. The above operation is referred to as the excavating operation first half, and such operation phase is referred to as excavating operation first half phase. Also, the arm angle β of the arm 5 in (B) of FIG. 8 is set up as a second threshold $\beta_{TH}$. The second threshold value $\beta_{TH}$ may be the arm angle β when the arm 5 is substantially perpendicular to the ground. The pump power required in the excavating operation first half is relatively low.

As illustrated in (C) of FIG. 8, the operator further closes the arm 5 to further gather the excavation target in area Da with the bucket 6. Then, the bucket 6 is closed until its upper edge is substantially horizontal (about 90 degrees) such that the gathered excavated soil is accommodated in the bucket 6, and the boom 4 is raised to raise the bucket 6 to the position illustrated in (D) of FIG. 8. The boom angle α of the boom 4 in the orientation illustrated in (D) of FIG. 8 is set up as a predetermined value "$\alpha_{TH2}$". The above operation is referred to as excavating operation latter half, and such operation phase is referred to as excavating operation latter half phase. The excavating operation latter half requires high pump power. The operation as illustrated in (C) of FIG. 8 may be a combined operation of the arm 5 and the bucket 6. In this way, the controller 30 can determine that the operation phase has changed from the excavating operation first half phase to the excavating operation latter half phase based on the orientation of the front work machine (the boom angle α and the arm angle β). Note that a change in the operation phase may also be determined using the operation amount of the arm 5 as a detection of the orientation of the front work machine. In this case, a change from the excavating operation first half phase to the excavating operation second half phase may be determined based on the duration of a period in which the arm operation amount is maximized.

In a normal excavating/loading operation such as a shallow digging excavating/loading operation, the required pump power differs between the operation phase when the arm angle β is less than the second threshold value $\beta_{TH}$ and the operation phase when the arm angle β is not less than the second threshold value $\beta_{TH}$. Such a feature of the normal excavating/loading operation according to the present alternative embodiment is a variation from the above-described embodiments. Thus, in the present alternative embodiment, when the orientation (angle) of the arm 5 as the "orientation of the front work machine" is less than the second threshold value $\beta_{TH}$, the pump power is increased. Note that the present alternative embodiment also implements the pump power control according to the orientation (angle) of the boom 4 as the "orientation of the front work machine" described above with reference to FIGS. 1 to 7.

Then, the operator raises the boom 4 until the bottom of the bucket 6 is at a desired height from the ground while maintaining the upper edge of the bucket 6 substantially horizontal as illustrated in (E) of FIG. 8. The desired height may be a height greater than or equal to the height of a dump, for example. When the boom angle α becomes greater than or equal to the first threshold value $\alpha_{TH1}$, the controller 30 determines that the operation phase has changed from the excavating operation phase to the boom raising turning operation phase and controls the pump power of the main pumps 12L and 12R to decrease so that the operation speeds of the hydraulic actuators gradually decrease. Subsequently or at the same time, the operator turns the upper turning body 3 in the direction indicated by arrow AR3 to move the bucket 6 to a position where it can deposit the excavated soil. Relatively high pump power is required at the beginning of the boom raising operation, and the pump power has to be controlled to gradually decrease to a lower pump power in the subsequent boom raising turning operation.

After completing the boom raising turning operation, the operator opens the arm 5 and the bucket 6 as illustrated in (F) of FIG. 8 to deposit the soil accommodated in the bucket 6. Note that in this dumping operation, only the bucket 6 may be opened to deposit the soil. A relatively low pump power is required in the dumping operation phase.

After completing the dumping operation, the operator turns the upper turning body 3 in the direction indicated by arrow AR4 as illustrated in (G) of FIG. 8 to move the bucket 6 to a position right above the excavation position. At this time, the boom 4 is lowered to lower the bucket 6 to a desired height from the excavation target in conjunction with the turning operation. The pump power required in the boom lowering turning operation phase is lower than the pump power required in the dumping operation phase. Thereafter, the operator lowers the bucket 6 to a desired height as illustrated in (A) of FIG. 8 and executes the excavating operation once again.

The operator repeats the above cycle including the "excavating operation first half", the "excavating operation latter half", the "boom raising turning operation", the "dumping operation", and the "boom lowering turning operation" to thereby advance the "normal excavating/loading operation". As can be appreciated, in the present alternative embodiment, the pump power of the hydraulic pumps is controlled according to the orientation of the front work machine within the work area N.

The work area N includes the area where the bucket 6 may reside when the "excavating operation first half", the "excavating operation latter half", and the "boom raising turning operation" are performed. The work area N may be preset according to the shape of the cabin 10 or the model (size) of the hydraulic excavator, for example.

In the following, a process of controlling the pump power according to the arm angle β of the arm 5 and the boom angle α of the boom 4 will be described with reference to FIG. 9. FIG. 9 illustrates a temporal transition of the pump power W in response to control of the pump power W implemented by the controller 30. In this process, the lever operation amount of the boom operation lever (not shown) and the operation amount of the arm operation lever 16A are constant.

Figure 9:
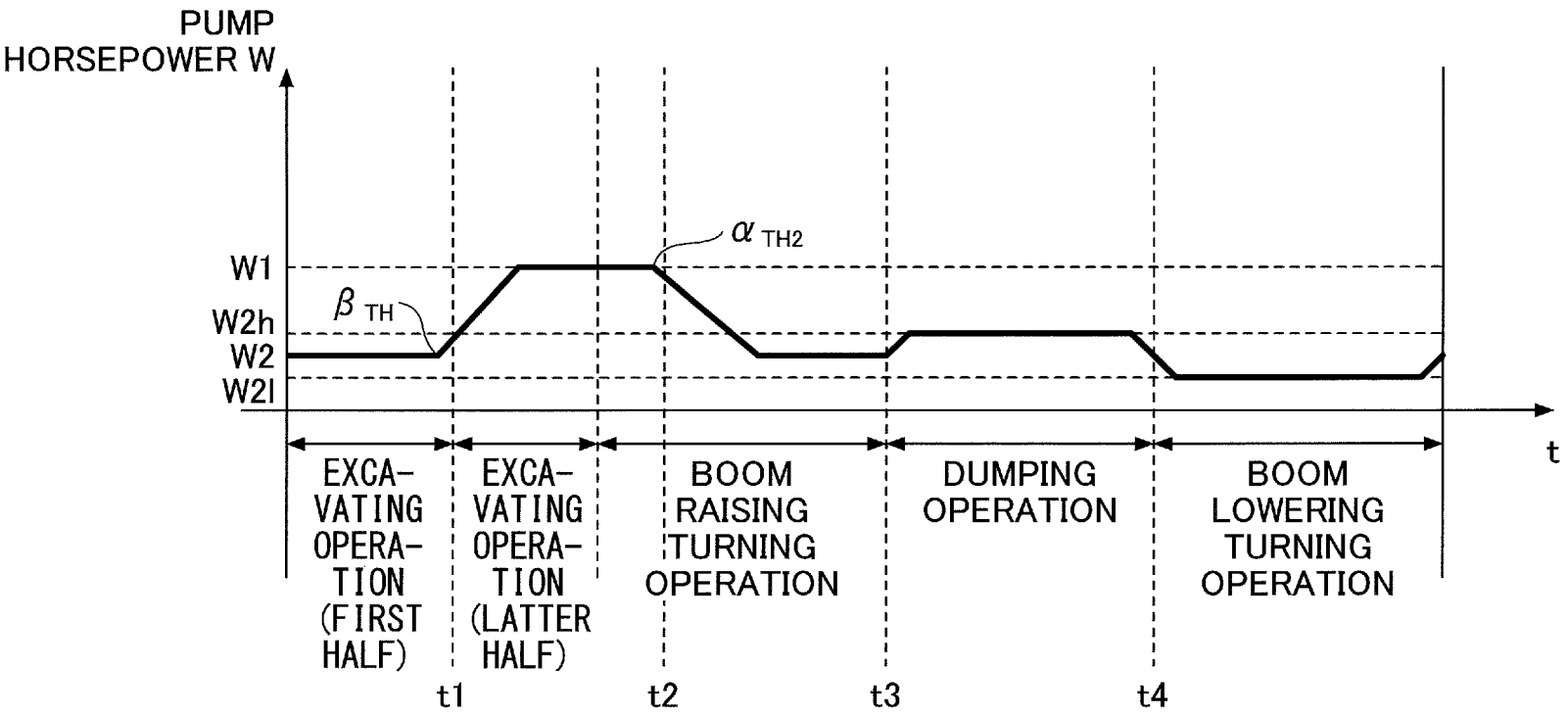
FIG. 9 is a diagram illustrating a temporal transition of the pump power in the operation flow of FIG. 8.

The temporal transition of the pump power W in FIG. 9 is basically similar to the temporal transition of the pump power W in FIG. 6. However, the temporal transition of the pump power W during the excavating operation first half and the excavating operation second half differs from that in FIG. 6. Also, the work mode is initially set to H mode corresponding to the fuel efficiency mode (see graph line H in FIG. 4A).

During the excavating operation first half as illustrated in (A) and (B) of FIG. 8 in which the arm 5 is closed from an open state until it is substantially perpendicular to the ground, the pump power W is controlled to be a low pump power W2.

At time t1, the controller 30 determines that the arm angle β is less than the second threshold value $\beta_{TH}$. Note that as the arm 5 is closed, the arm angle β decreases. Thereafter, the controller 30 adjusts the swash plate tilt angle of the main pumps 12L and 12R using the regulators 13L and 13R to change the pump power W and controls the discharge flow rate Q of the main pumps 12L and 12R to increase so that the pump power W gradually increases to a pump power W1. Note that the second threshold value $\beta_{TH}$ may be the arm angle β when the arm 5 is substantially perpendicular to the ground (e.g., arm angle β when the arm 5 is 90±5 degrees with respect to the horizontal plane) as illustrated in (B) of FIG. 8, for example.

At time t2, the controller 30 determines that the boom angle α is greater than or equal to the predetermined value $\alpha_{TH2}$. The predetermined value $\alpha_{TH2}$ is the value of the boom angle α when the boom 4 is in the orientation as illustrated in (D) of FIG. 8 and may be set to a value that is greater by a predetermined angle (e.g., 30 degrees) than the boom angle α when the boom 4 is at its lowest position, for example.

The controller 30 gradually reduces the pump power W so that the discharge flow rate Q of the main pumps 12L and 12R remains constant (does not increase).

The controller 30 gradually reduces the pump power W from W1 to W2 as it progresses from time t2 to time t3. Note that in the present example, a determination is made to switch to pump power reduction control based on the boom angle α at time t2. However, the determination of whether to switch to pump power reduction control may also be made based on the arm angle β. Although a relatively high pump power is required in the excavating operation latter half, depending on the circumstances of the work site, a high pump power may not be required after the arm angle β has been closed, for example. In such a case, when the orientation (angle) of the arm 5 is less than a predetermined value $\beta_{TH2}$ (e.g., angle obtained by subtracting 110 degrees from the maximum angle) that is set up as a third threshold value, pump power reduction control for reducing the pump power W may be implemented.

At time t3, the controller 30 adjusts the swash plate tilt angle of the main pumps 12L and 12R using the regulators 13L and 13R to change the pump power W and increases the discharge flow rate Q of the main pumps 12L and 12R to increase the pump power W from pump power W2 to pump power W2*h*. Time t3 is the time at which the dumping operation as illustrated in (F) of FIG. 8 is started.

At time t4, the controller 30 adjusts the swash plate tilt angle of the main pumps 12L and 12R using the regulators 13L and 13R to change the pump power W and lowers the discharge flow rate Q of the main pumps 12L and 12R to change the pump power W from pump power W2*h* to pump power W2*l*. Time t4 is the time at which the boom lowering turning operation as illustrated in (G) of FIG. 8 is started.

At this time, control may be implemented for gradually reducing the rotational speed of the engine 11 so that the discharge flow rate Q remains constant as illustrated in FIG. 7, for example.

Thus, in the present alternative embodiment, even when the load (discharge pressure P) decreases, the discharge flow rate Q is maintained constant and the operation speed of the attachment is maintained constant such that operability and fuel efficiency may be substantially improved.

Although the present invention has been described above with respect to certain illustrative embodiments, the present invention is not limited to the above-described embodiments, and various changes and modifications may be made without departing from the scope of the present invention.

What is claimed is:

1. An excavator comprising:

a lower traveling body;

an upper turning body mounted so as to turn with respect to the lower traveling body;

a hydraulic pump connected to a power source;

a front work machine including an end attachment, an arm, and a boom that are driven by hydraulic fluid from the hydraulic pump;

a sensor configured to detect an orientation of the front work machine; and a hydraulic control system that increases a power of the hydraulic pump according to the orientation of the front work machine within a work area surrounded by an upper work area and a distal end work area, based on a value detected by the sensor, during a latter half of excavation or during a process of raising the boom.

2. The excavator according to claim 1, wherein the sensor includes a boom angle sensor configured to detect a boom angle of the boom; and the hydraulic control system controls the power of the hydraulic pump according to the boom angle detected by the boom angle sensor.

3. The excavator according to claim 1, wherein the sensor includes an arm angle sensor configured to detect an arm angle of the arm; and the hydraulic control system controls the power of the hydraulic pump according to the arm angle detected by the arm angle sensor.

4. The excavator according to claim 1, wherein the hydraulic control system reduces the power of the hydraulic pump in a case where a boom angle of the boom is greater than or equal to a first threshold value.

5. The excavator according to claim 1, wherein the hydraulic control system increases the power of the hydraulic pump in a case where an arm angle of the arm is less than a second threshold value.

6. The excavator according to claim 1, wherein the hydraulic control system reduces the power of the hydraulic pump in a case where an arm angle of the arm during the latter half of the excavation is less than a third threshold value.

7. The excavator according to claim 1, wherein the hydraulic control system controls the power of the hydraulic pump by adjusting a regulator.

8. The excavator according to claim 1, wherein the hydraulic control system controls the power of the hydraulic pump by changing a rotational speed of the power source.

9. The excavator according to claim 1, wherein the hydraulic control system determines whether an operation phase has changed based on the orientation of the front work machine within the work area.

10. The excavator according to claim 1, wherein the sensor detects the orientation of the front work machine using an image photographed by a camera configured to photograph the front work machine.

11. The excavator according to claim 1, wherein the hydraulic control system determines a depth of digging based on the orientation of the front work machine.

12. The excavator according to claim 1, wherein the upper work area is an area in which the end attachment resides when a boom angle of the boom is within a predetermined range of angles less than or equal to a maximum boom angle, and the distal end work area is an area in which the end attachment resides when the boom angle is greater than or equal to a threshold value and an arm angle of the arm is within a predetermined range of angles less than or equal to a maximum arm angle.

13. The excavator according to claim 1, wherein the hydraulic control system keeps a discharge flow rate of the hydraulic pump constant as a discharge pressure of the hydraulic pump decreases.

* * * * *